US006026538A

United States Patent [19]

Watanabe

[11] Patent Number: 6,026,538

[45] Date of Patent: Feb. 22, 2000

[54] ROBOT SYSTEM FOR DUCT CLEANING

[75] Inventor: Yasuo Watanabe, Musashimurayama, Japan

[73] Assignee: M. T. System Co., Ltd., Higashimurayama, Japan

[21] Appl. No.: 09/079,522

[22] Filed: May 15, 1998

[51] Int. Cl.[7] ..... A47L 5/00

[52] U.S. Cl. ..... 15/304; 15/406

[58] Field of Search ..... 15/304, 383, 395, 15/406

[56] References Cited

U.S. PATENT DOCUMENTS

| | | | |
|---|---|---|---|
| 4,473,921 | 10/1984 | Weber et al. | 15/304 |
| 4,984,329 | 1/1991 | Wade | 15/395 |
| 5,428,862 | 7/1995 | Sailer | 15/304 |
| 5,472,514 | 12/1995 | Grimsley | 15/395 |
| 5,572,766 | 11/1996 | Matsuura et al. | 15/304 |
| 5,584,093 | 12/1996 | Melendres | 15/395 |
| 5,813,089 | 9/1998 | Nolan et al. | 15/395 |
| 5,862,568 | 1/1999 | Sjoberg | 15/304 |

FOREIGN PATENT DOCUMENTS

| | | | |
|---|---|---|---|
| 1014720 | 8/1957 | Germany | 15/395 |
| WO 95/00262 | 1/1995 | WIPO | 15/395 |

*Primary Examiner*—Terrence R. Till
*Attorney, Agent, or Firm*—Armstrong, Westerman, Hattori, McLeland & Naughton

[57] ABSTRACT

The object of the present invention is to provide a robot system for duct cleaning, by which it is possible to detach and remove dust, dirt, etc. inside ducts almost completely and to reduce personnel cost and other cost, and which can be applied to any type of duct. The present invention provides a robot system for duct cleaning used for detaching and removing dust, dirt, etc. attached and accumulated inside the duct. The robot system comprises a robot unit for detaching and removing dust inside the duct and a hose of a dust collector connected to the duct and used for sucking the detached dust. By injecting the air from the air hose made of freely flexible material in backward direction, the robot is moved forward.

8 Claims, 6 Drawing Sheets

ROBOT SYSTEM FOR DUCT CLEANING

BACKGROUND OF THE INVENTION

The present invention relates to a robot system for cleaning inside ducts by removing dust, dirt, etc. attached and accumulated in air-conditioning duct, exhaust air duct, dust collecting duct, etc. in factories, buildings, etc.

Conventional type ducts for discharging air or gas used in such facilities as restaurants, lunch rooms, etc. where a large quantity of oil is used have such problems that oil, dust, and dirt are accumulated in the duct within a short time, and this often causes fires or other problems.

In a clean room used in semiconductor industry and in a vacuum packaging room in food industry, it is desirable to create conditions where dust, dirt, bacteria, etc. are eliminated. However, even when the rooms are thoroughly cleaned, problems arise that dust, dirt, bacteria, etc. enter the rooms through ducts.

In the past, the cleaning operation of the ducts has been performed in various procedures as described below, but satisfactory method suitable for practical application has not yet been established for perfectly cleaning the inside of the duct. At present, various methods are being attempted by trial and error as follows:

(1) An air hose is inserted into duct, and high pressure air is sent into the air hose and is injected, and dust, dirt, etc. are removed by the injected high-speed air stream.

(2) An object like a streamer is sent into duct under pressure by a fan, and by hitting the inner side of the duct by the streamer-like object, accumulated and attached dust, dirt, etc. are detached and collected.

(3) A number of holes are prepared on the duct, and a hose of air cleaner is inserted through each of the holes, and internal portion of the duct is cleaned up by manual operation.

(4) A number of holes are formed on duct with equal spacings. A device such as valve is mounted on each of the holes, and a hose with small diameter is inserted into the hole, and the hose is jerked and moved around by high pressure air to detach and remove dust, dirt, etc., and these are discharged to outside through a vinyl hose or the like via duct outlet.

(5) A motorized robot is placed into duct, and inner side of the duct is cleaned up using rotary brushes mounted on the robot.

According to the method described in (1) above, it is impossible to perfectly detach and remove dust, dirt, etc. accumulated in duct over a long time using high-pressure air, turbulent air stream, etc. In particular, it is often difficult to perform the cleaning operation in case there is a damper or a branched portion of the duct.

In the method described in (2) above, the diameter of the duct is reduced from a position closer to the air-conditioner toward the blowing outlet on the duct. Because a damper (for volume adjustment) is provided at the middle of the duct, the stream-like object must be repeatedly inserted, and this is not very efficient. Also, in the case dust has been accumulating for a long period and is firmly attached, the effect to remove dust is very low.

According to the method (3) as described above, it is possible to clean a duct with large diameter, while 70 to 80% of the ducts currently in use have a smaller diameter. This method is not very efficient in case of a duct with small diameter. Also, the cleaning operation cannot be performed due to restriction from architectural reasons.

According to the method (4) as described above, high-pressure air is sent through a device such as valve and a hose with small diameter is moved and jerked around to detach the dust. However, it is not possible to have air flow moving at high speed, and the effect of detaching and removing the accumulated dust is low. Moreover, if the vinyl hose leading from the outlet to the outside is removed, dust may scatter all over the room, and much labor and time may be required to eliminate the trouble, and this is not recommendable.

The method described in (5) above is advantageous in that it is possible to partially record cleaning condition. However, in case there is an obstacle such as damper in the duct, some portion of the duct may not be cleaned up using the motorized robot due to the size of the duct, and this method lacks suitability for universal application.

SUMMARY OF THE INVENTION

To solve the above problems, it is an object of the present invention to provide a robot system for duct cleaning, by which it is possible to detach and remove dust, dirt, etc. inside a duct almost completely and to reduce personnel cost and other costs, and which can be applied to any type of duct.

It is another object of the present invention to provide a robot system for duct cleaning, by which it is possible to detach and remove dust, dirt, etc. accumulated inside the duct easily and very efficiently.

According to the present invention, the detached dust now in floating state can be sent in backward direction without causing the detached dust to move downward or to precipitate and the dust can be easily collected into a hose of a dust collector arranged at a backward position.

To attain the above objects, the robot system for duct cleaning used for detaching and removing dust, dirt, etc. attached and accumulated inside a duct comprises a robot for detaching and removing dust, dirt, etc. inside the duct, and a hose of a dust collector connected to duct and used for sucking the detached dust by turning pressure inside the duct to negative pressure, whereby the robot is provided with brush units rotated by air from an air hose made of freely flexible material, and the robot is moved forward by injecting the air in backward direction.

The above and other objects and advantages of the invention will become more apparent from the following description:

DETAILED DESCRIPTION OF THE PREFERRED EMBODIMENTS

In the following, description will be given on embodiments of the present invention referring to the attached drawings.

Figure 1:
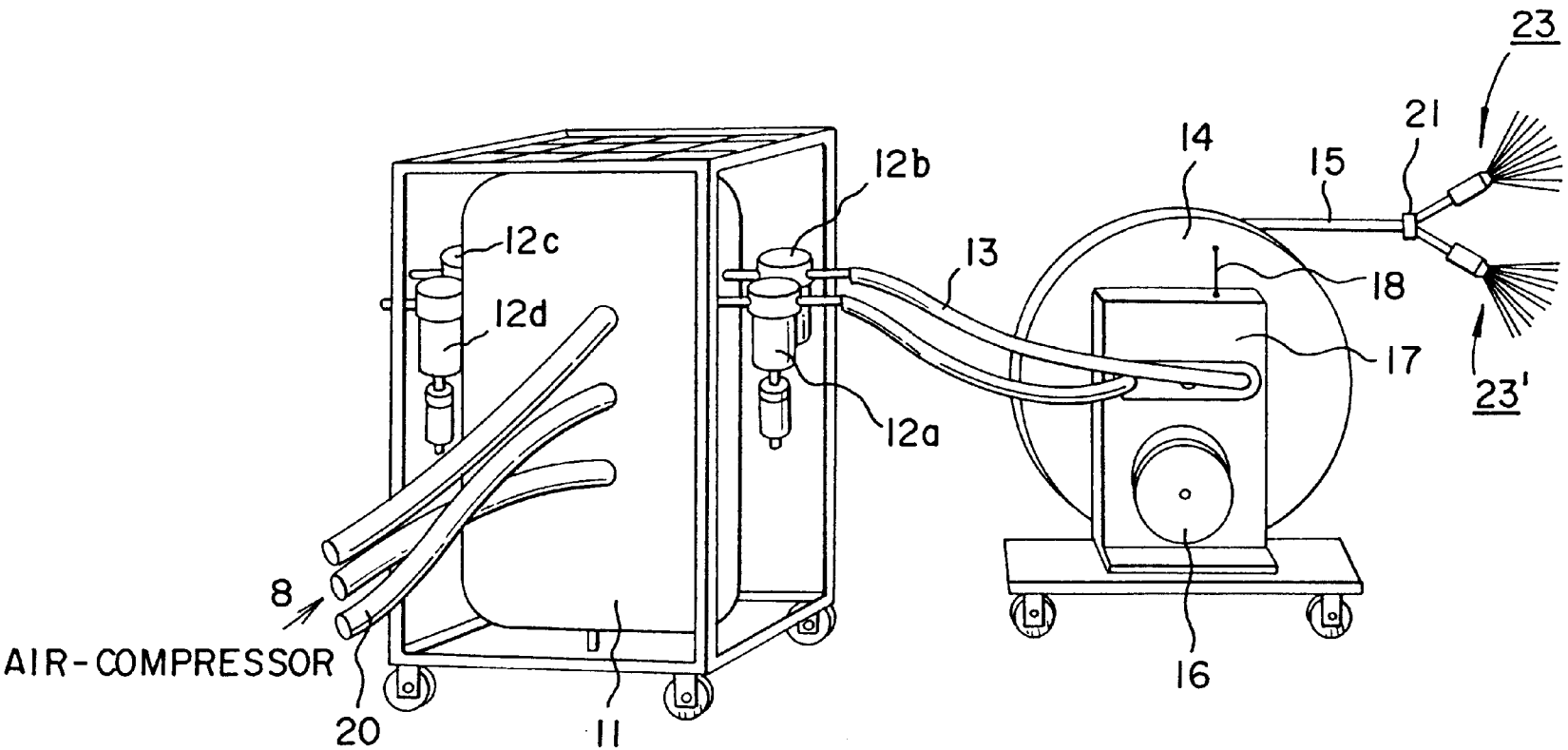
FIG. 1 is a perspective view of a robot system for duct cleaning according to the present invention.

FIG. 1 is a perspective view of a robot system for duct cleaning according to the present invention. From an air compressor, air 8 is introduced into a air drying unit 11 through an air hose 20. Moisture is removed while the air is passed through moisture removing units 12*a,* 12*b,* 12*c,* and 12*d,* and it is then sent into an air hose 13.

The air hose 13 is connected to an air hose 15 via an air hose drum 14. At the tip of the air hose 15, main units 23 and 23' of the robot system for duct cleaning are connected via a connector 21.

Figure 2:
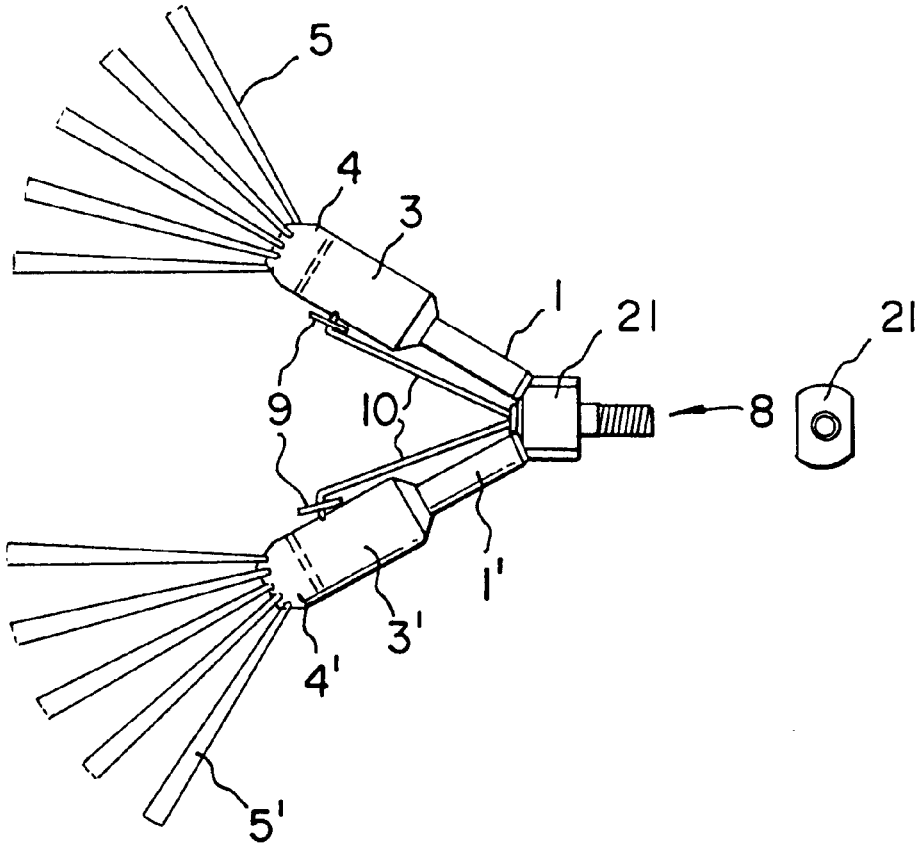
FIG. 2 represents a side view and a rear view of main units of the robot system for duct cleaning.
Figure 4:
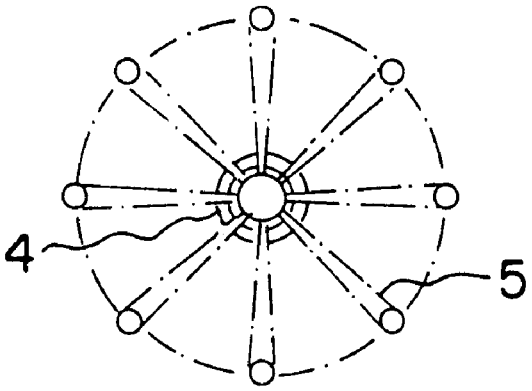
FIG. 4 is a front view of a brush unit of the main unit of the robot system for duct cleaning.

As shown in FIG. 2, the main units 23 and 23' of the robot system for duct cleaning comprise respectively pipes 1 and 1' screwed into the connector 21 in such manner that the pipes are directed in different directions at an angle, rotating components 3 and 3' rotatably engaged with the pipes 1 and 1' and brush fixing units 4 and 4' firmly engaged at the tip of each of the rotating components 3 and 3'. As shown in FIG. 4, each of brushes 5 and 5' is spread in circumferential direction at the forward portion of each of the brush fixing units 4 and 4' so that the brushes are spread in a forward direction.

Figure 3:
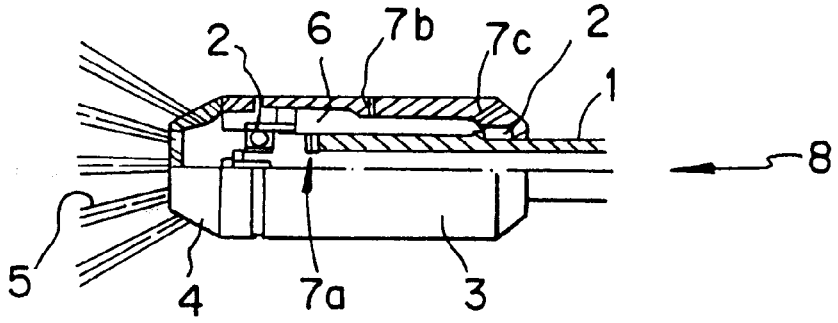
FIG. 3 is a partially cutaway cross-sectional view of the main unit of the robot system for duct cleaning.

As shown in FIG. 3, the pipes 1 and 1' and the rotating components 3 and 3' are rotatably engaged with each other via bearings 2*a* and 2*b* respectively.

A through-hole 7*a* is formed at the tip of the pipe 1 (1'), and an impeller 6 is fixed on inner periphery of the rotating component 3 (3') closer to the through-hole 7*a*. At the center and at the rear end of the rotating component 3 (3'), air nozzles 7*b* and 7*c* are provided respectively.

After being discharged from the through-hole 7*a,* the air strikes the impeller 6 and generates a rotating force. Thus, the rotating component 3 (3') is rotated together with the brush 5 (5') at high speed, and the air is discharged through the air nozzle 7*b*. At the same time, the air discharged through the air nozzle 7*c* gives reverse blowing force to the rotating component 3 (3'). As a result, the rotating components are moved forward while being rotated.

Figure 5:
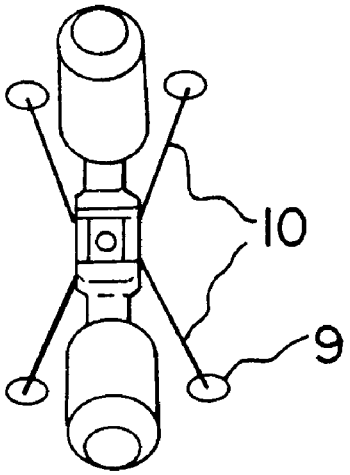
FIG. 5 is a front view of the main unit of the robot system for duct cleaning according to the present invention.

As shown in FIG. 2 and FIG. 5, wheels 9 are connected to the connector 21 respectively via wheel shafts 10, which are made of piano wire (wire with a resilient property). Accordingly, the rotating component 3 (3') is smoothly moved forward by the wheel 9. By the action of the wheel shaft 10 made of piano wire, the rotating component 3 (3') is rotated, moved forward or jerked around in such manner that dust, dirt, etc. accumulated inside the duct can be perfectly detached and moved away.

In the above embodiment, two wheel shafts 10 mounted with wheels are fixed respectively above and under a virtual plane connecting the rotating components 3 and 3'. As a result, even when the rotating components 3 and 3' are turned upside down, these can be operated without any trouble.

After being detached from the duct, dust, dirt, etc. are sent backward together with the air, which is discharged through the air nozzle 7*c*.

Figure 7:
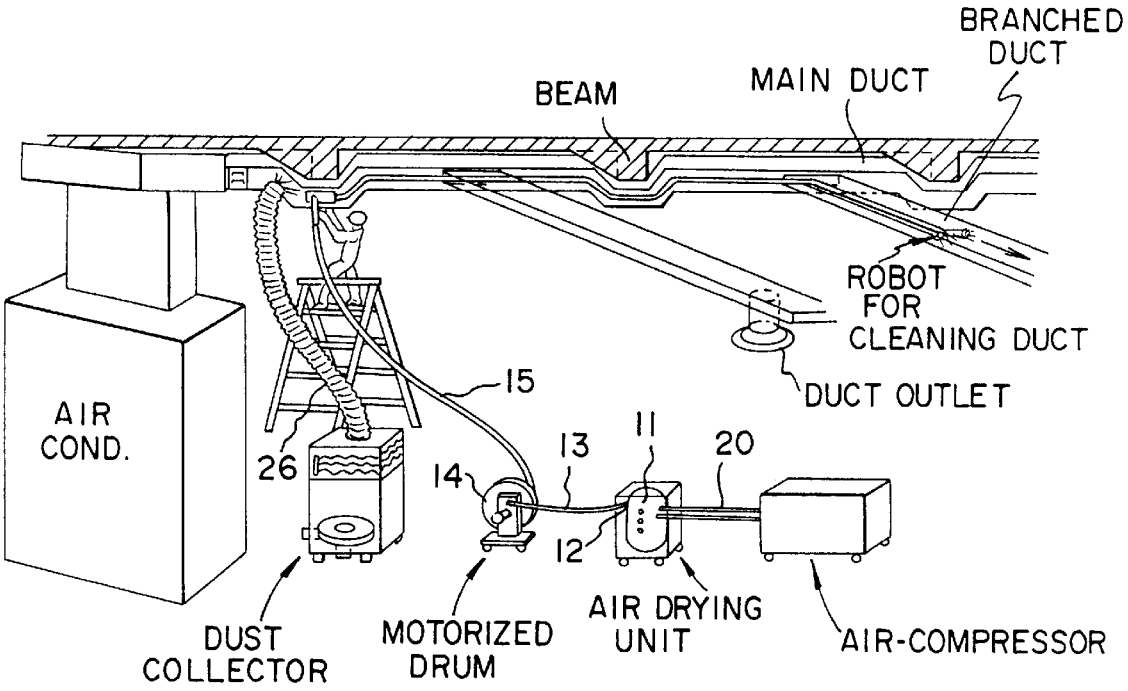
FIG. 7 is a schematical illustration of an embodiment of the robot system for duct cleaning according to the present invention, showing how the system operates.

As shown in FIG. 7, dust, dirt, etc. sent backward are collected in a filter box of a dust collector through a hose 26 of the dust collector connected with the duct.

A turbo type fan is connected with the dust collector, and when the dust collector is operated, pressure inside the duct to be cleaned is turned to negative pressure. Thus, it is possible to effectively collect the removed dust, dirt, etc.

When the main units 23 and 23' of the robot system for duct cleaning are moved forward, the air hose 15 is unwound from the air hose drum 14. By rotating the air hose drum 14 in the reverse direction, the air hose 15 is wound up, and main units 23 and 23' of the robot system for duct cleaning are moved backward.

As shown in FIG. 1, the air hose drum 14 is rotated by a motor 16. A control box 17 is operated using a portable wireless switch, and rotation of the motor and air flow into the air hose 15 are controlled. Also, forward and backward movements and stopping of the main units 23 and 23' of the robot system for duct cleaning can be controlled. In the figure, reference numeral 18 represents an antenna for wireless communication.

It is preferable that the air hose 15 used in the present invention is about 20 to 30 mm in diameter, and it is resistant to pressure of about 7 atmospheres of pressure and is made of synthetic resin, which is lightweight, soft and flexible.

Figure 6:
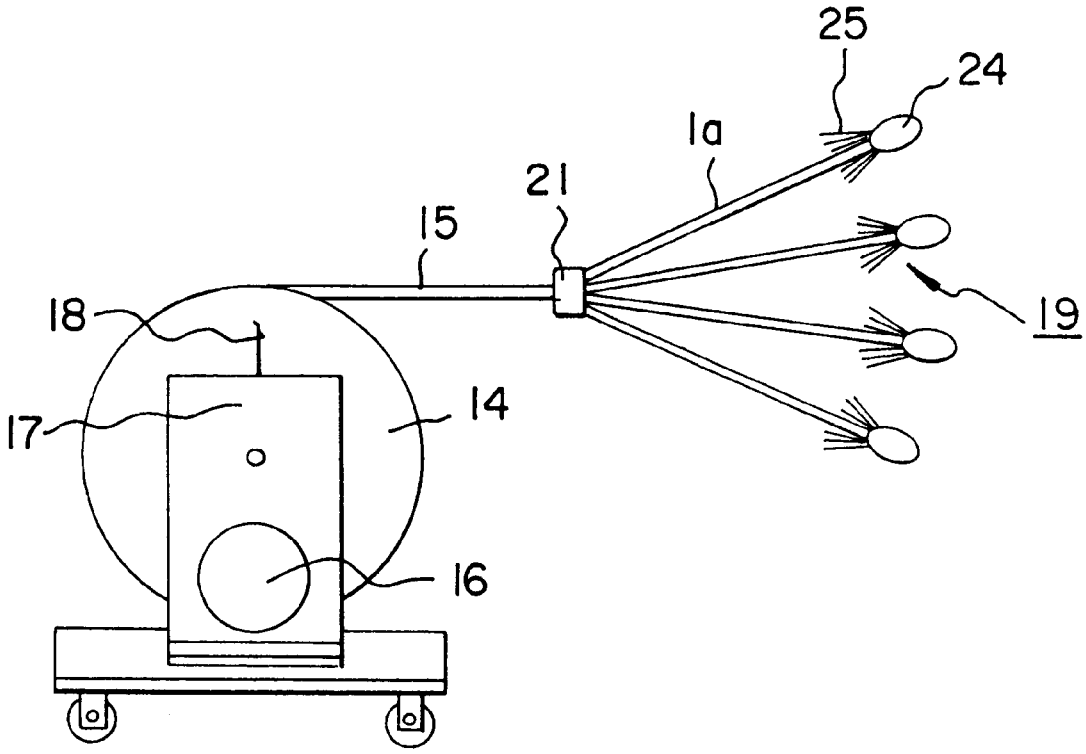
FIG. 6 is a side view of an example of a robot system for collecting the remaining dust after cleaning operation by the robot system for duct cleaning of the present invention.

FIG. 6 shows a robot system for duct cleaning of the above embodiment, which can be moved after cleaning operation. In this example, reverse injection nozzles 19 are connected to the air hose 15 via the connector 21.

Each of the reverse injection nozzles 19 comprises a metallic hollow body 24 of ellipsoidal shape firmly fitted on each of pipes 1*a.* On rear portion of the hollow body 24, a number of air nozzles are formed. A wheel (not shown) is connected to the connector 21.

Each of the hollow bodies 24 is moved forward by reverse injection force of high-pressure air introduced into it. Then, the hollow bodies 24 move and jerk all over inside the duct. Turbulent air flow is generated by the injected high-pressure air 25, and accumulated dust, dirt, etc. inside the duct are removed by the turbulent air flow. The dust, dirt, etc. thus detached are sent backward by the reverse injection force and are collected in the dust collector. By the air flow from the reverse injection nozzles 19, the robot system for duct cleaning of the above embodiment is moved after cleaning operation, and the remaining dust in small quantity can be collected.

FIG. 7 shows an embodiment of the invention, in which the entire space inside a horizontal duct system including a main duct and branched ducts is cleaned up by the robot system for duct cleaning.

High-pressure air discharged from a high-pressure air compressor is sent into an air drying unit 11 via an air hose 20. Moisture in the high-pressure air is removed by the moisture removing unit 12. The air thus dried is introduced into the air hose 15 through an air hose 13 and a motorized drum 14.

The air introduced into the air hose 15 is then sent to the main units 23 and 23' of the robot system for duct cleaning. By the reverse injection force of the air, the accumulated dust inside the duct is removed by rotating brushes, and the robot is moved forward. The robot further passes through irregular passages of the branched duct or in shielding plate (damper) inside the duct and performs the cleaning operation.

When it is detected that the main units 23 and 23' of the robot system for duct cleaning have reached a branched duct according to the length of unwound portion of the air hose 15, the air hose 15 is rotated to some extent to change the direction of the robot main unit. Then, the robot main unit smoothly enters into the branched duct by the force of reverse injection.

The removed dust now floating in the air is sent backward by the reversely injected high-pressure air and is sucked by the hose 26 of the dust collector arranged near an air-conditioner located at backward position.

Figure 8:
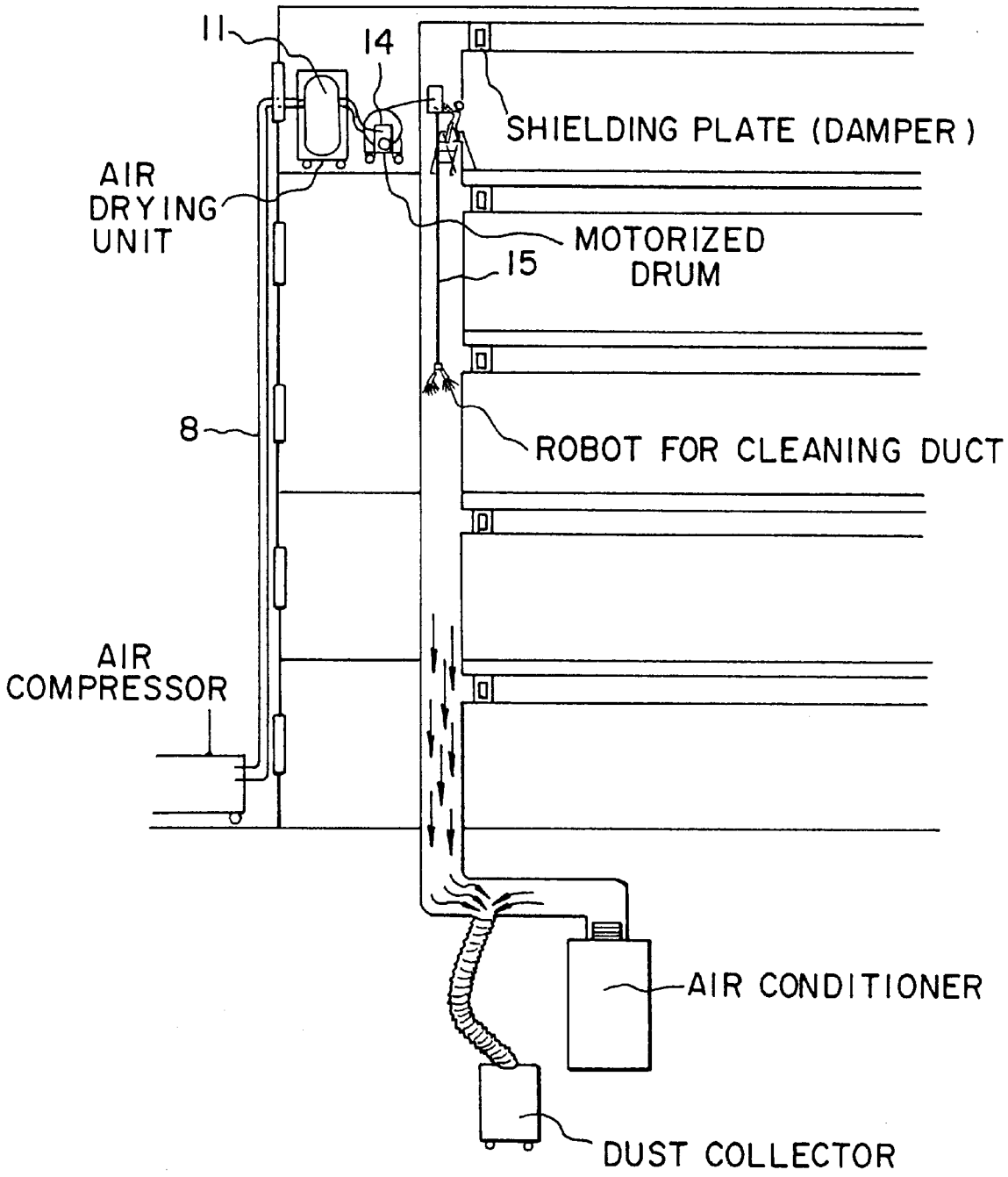
FIG. 8 is a side view of another embodiment of the robot system for duct cleaning.

FIG. 8 shows an example of cleaning operation in a vertical duct using the robot system for duct cleaning according to the present invention.

The main units 23 and 23' of the robot for cleaning duct are moved down along the vertical duct while removing dust inside the duct by reverse injection force of the air. The removed dust now floating in the air is moved down by suction force of the dust collector positioned under the duct and is collected in the dust collector.

The hose of the dust collector is arranged at a position upstream of the flow in the duct. In case of an air-conditioning duct, it should be arranged at a position closer to the air-conditioning system. In case of an exhaust air duct at a factory, it should be arranged at a position closer to an exhaust fan. In case of a dust collecting duct, it should be arranged closer to the dust collector. As a matter of course, operation of the air-conditioning duct may be stopped during the cleaning operation. In this way, by arranging the hose of the dust collector at a position upstream of the flow, it is possible to prevent intrusion of the removed dust into the branch duct, and dust can be effectively collected into the dust collector.

As described above, a simple mechanism to reversely inject the air is adopted in the present invention, and the robot for cleaning duct can be moved forward, rotated or jerked or shaken around. As a result, dust, dirt, etc. accumulated inside the duct can be easily and efficiently detached and removed. Because the air is injected in backward direction, the detached dust in a floating state can be sent backward and it is prevented from moving downward or from precipitating, and the dust can be easily collected into the hose of the dust collector arranged at backward position.

Further, the robot system for duct cleaning is driven by the air, and this means that there is no possibility to cause fire, which may occur by ignition of cotton dust or the like inside the duct because of an electrical short.

Because the duct cleaning robot can be designed in compact size, it can be applied to any type of duct. In addition to universal application, the robot can reduce personnel cost and other cost compared with the conventional technique used in the past for duct cleaning.

What is claimed is:

1. A robot system for cleaning a duct by detaching, removing and cleaning material including dust and/or dirt, attached and accumulated inside the duct, the system comprising a first robot for detaching and removing material inside the duct, and a collector having a hose connected to duct and used for sucking the detached material by generating a negative pressure inside the duct, said robot having a brush unit, rotating components connected to the brush unit an air hose made of freely flexible material connected to the rotating component such that air from the air hose causes the rotating component and brush unit to rotate, and the robot further including a nozzle for injecting air from the air hose in a backward direction so as to move the robot in a forward direction.

2. A robot system according to claim 1, wherein said hose of the collector is arranged at a position upstream of the flow in said duct.

3. A robot system according to claim 2, wherein the air from said air hose is injected backward to move the detached and removed material in backward direction and the material is collected from the hose of the collector.

4. A robot system according to claim 1, wherein said rotating component for rotating said brush unit includes a pipe having a through hole and a nozzle and being connected to a tip of the air hose either directly or via a connector, said rotating component having impellers firmly fixed on an inner side and with said brush unit mounted at a forward end, said rotating component rotatably mounted on said pipe via bearings, whereby air flow in the through hole strikes said impellers of said rotating component and is reversely injected from the nozzle at rear portion of the rotating component so that said rotating component is moved forward and rotated.

5. A robot system according to claim 4, wherein said rotating component includes a connector and wheels connected to said connector via a wire having resilient property so that said rotating components can be moved forward, rotated, jerked and shaken around.

6. A robot system according to claim 1, further including an air drying unit wherein the air from a high-pressure air compressor is dried, and the dried air is introduced into the air hose.

7. A robot system according to claim 6, wherein said collector comprises an air filter for collecting the detached and removed material and a turbo type fan.

8. A robot system according to claim 1, wherein there is provided a second robot for collecting small quantity of the dust remaining inside the duct after cleaning operation of the duct by the robot for detaching and removing dust inside the duct, said second robot comprising a reverse injection nozzle for reversely injecting air in backward direction connected to the air hose via a connector, whereby said reverse injection nozzle is moved forward, jerked and shaken around by reverse injection force of the air.

* * * * *